United States Patent [19]

Burgess

[11] Patent Number: 4,671,515

[45] Date of Patent: Jun. 9, 1987

[54] CARD GAME DEVICE

[76] Inventor: Step L. Burgess, 154 Mulberry Dr., New Castle, Ala. 35119

[21] Appl. No.: 789,332

[22] Filed: Oct. 21, 1985

[51] Int. Cl.[4] ..... A63F 1/02

[52] U.S. Cl. ..... 273/293; 273/150; 273/299

[58] Field of Search ..... 273/293, 299

[56] References Cited

U.S. PATENT DOCUMENTS

| | | | |
|---|---|---|---|
| 1,766,465 | 6/1930 | Snelling | 273/293 |
| 2,652,635 | 9/1953 | Conger | 273/293 X |
| 3,263,999 | 8/1966 | McCoy | 273/293 |
| 3,411,221 | 11/1968 | Clark | 273/293 |
| 3,658,342 | 4/1972 | Boren | 273/293 |
| 3,873,092 | 3/1975 | Fagan | 273/269 X |
| 4,140,320 | 2/1979 | Cortimilia | 273/293 |

FOREIGN PATENT DOCUMENTS

| | | | |
|---|---|---|---|
| 1431036 | 1/1966 | France | 273/293 |

*Primary Examiner*—Anton O. Oechsle
*Attorney, Agent, or Firm*—James D. Long

[57] ABSTRACT

A card game device embodying a first set of cards and a second set of cards with there being a plurality of spaced apart indicia on at least one face of each card of the first set of cards. The indicia are of a predetermined size and are arranged on each card of the first set of cards in a predetermined pattern. A character is disposed through each card of the second set of cards and is constructed and arranged to permit a predetermined number of indicia to be exposed therethrough upon the superimposition of each card of the second set of cards over a corresponding card from the first set of cards.

10 Claims, 9 Drawing Figures

CARD GAME DEVICE

This invention relates to a card game device and more particularly to an improved card game device which is capable of maintaining the interest of players of various age groups for a considerable period of time by stimulating a player's ability to match uniquely arranged unknown symbols with known characters to determine an unknown word or number.

As is well known in the art to which my invention relates, various card games have been devised to improve a player's perception and reasoning ability. One such card game is disclosed in U.S. Pat. No. 3,411,221. This word card game requires a player to utilize a complicated comparison procedure wherein cards having a predetermined arrangement of holes therein, which represent unknown words, are placed over cards having a blackened area thereon, which represent known words, for the purpose of determining how many letters in the unknown word appear in the known word. Successive comparisons of cards will eventually reveal the letters in the unknown word. This type of game is very complex and requires skill and judgment to play. Accordingly, it is limited to players of specific age groups and is a type of game which fails to hold the interest of players, especially small children, for any extended period of time.

SUMMARY OF THE INVENTION

In accordance with my present invention, I overcome the above and other difficulties by providing an improved card game device which is educational and interesting for players of all ages.

An object of my invention is to provide a card game device which is relatively simple in construction, inexpensive to produce and one which is interesting and amusing to play.

Another object of my invention is to provide a card game which may be played by one or more persons and requires no special skills or exercise of judgment beyond the spelling of words or the formation of numbers to win the game.

Still another object of my invention is to provide a card game device which is easy to comprehend and capable of maintaining a player's interest over a considerable period of time.

My improved card game device comprises at least one first set of cards and at least one second set of cards with their being a plurality of spaced apart indicia on at least one face of each card of the first set of cards. The indicia are of a predetermined size and are arranged on each card of the first set of cards in a predetermined pattern. A character is disposed through each card of the second set of cards and is constructed and arranged to permit a predetermined number of indicia to be exposed therethrough upon the superimposition of each card of the second set of cards over a particular corresponding card from the first set of cards.

DESCRIPTION OF THE DRAWINGS

A game card device embodying features of my invention is illustrated in the accompanying drawings forming a part of this application, in which.

DETAILED DESCRIPTION

Figure 1:
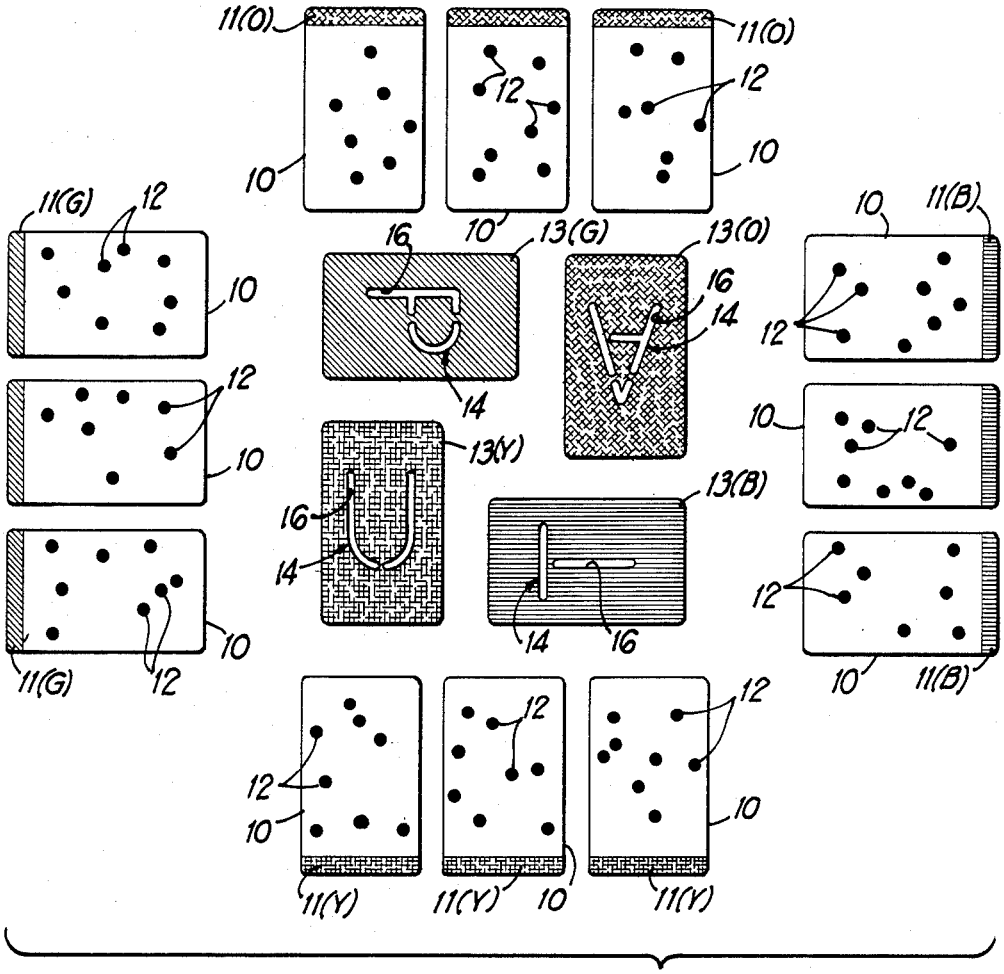
FIG. 1 is a plan view of a typical hand of cards between four players wherein character cards which are used to match with indicia cards dealt to each player have been placed in the middle between the players.
Figure 4:
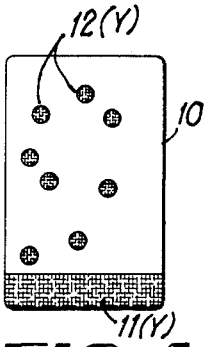
FIG. 4 is a view showing an alternate embodiment of an indicia card wherein the indicia are printed in a color that matches the color of its corresponding character card.

Referring now to the drawings for a better understanding of my invention, I show in FIG. 1 a typical hand of cards from my improved card game device being played by four players. In this illustrated embodiment, each of the players has been dealt three indicia cards [10] from a firs deck of indicia cards, not shown. Each of the indicia cards [10] is generally rectangular in shape and includes a color-coded strip across one of each card [10] as shown in FIGS. 1 and 4. The color-coded strips are designated as [11 G] (green), [11 O] (orange), [11 Y] (yellow), and [11 B] (blue) and divide the indicia cards [10] into four color-coded groups as shown.

A plurality of spaced-apart indicia [12] are provided on at least one face of each of the indicia cards [10], as shown. The indicia [12], which preferably are in the form of dots, are of a predetermined size and are arranged on each indicia card [10] in a predetermined pattern. That is, for this illustrated embodiment, eight indicia [12] are provided on each indicia card [10] with the indicia on each individual indicia card [10] arranged in a pattern which is a completely different pattern from the indicia pattern on each of the other indicia cards [10]. While I have shown the indicia [12] as being dots on each indicia card [10], it will be apparent from the following description that the indicia [12] may assume other shapes and be color coordinated to match or replace or augment its strip [11 (G)], [11 (O)], [11 (Y)] or [11 (B)], as shown in FIG. 4.

Figure 5:
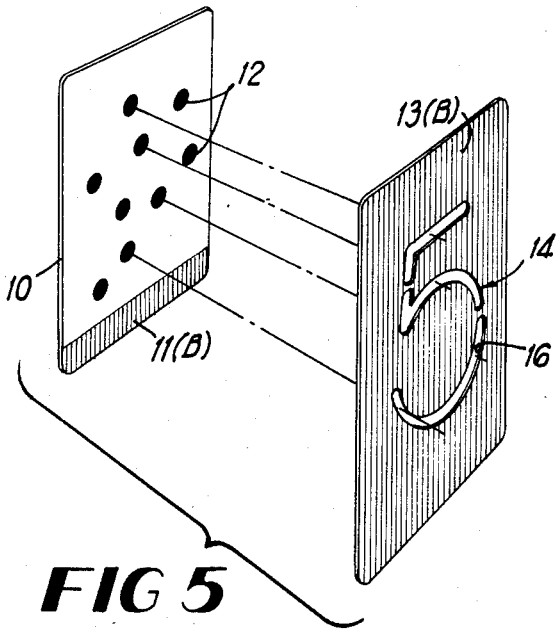
FIG. 5 is an exploded perspective view showing an indicia card and a character card before they are superimposed over each other.
Figure 6:
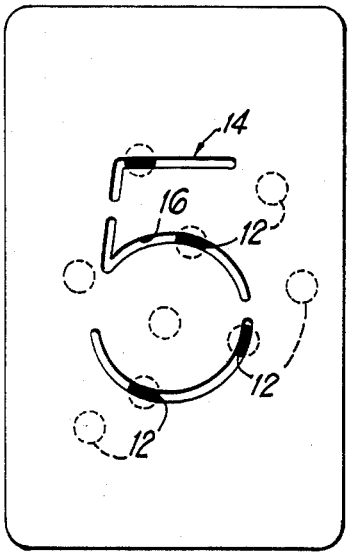
FIG. 6 is a view showing a superimposed character card over a matching indicia card wherein four dots or portions thereof show through the cutout portions in the character card with the color designation of the character card omitted for clarity.

As shown in FIG. 1, four cards from a deck of character cards are disposed between the players. The character cards are divided into four color-coded sets which correspond to the four colors of the strips [11 (G)], [11 (O)], [11 (Y)] and [11 (B)] across one end of each of the indicia cards [10] and are indicated as [13 (G)], [13 (O)], [13 (Y)] or [13 (B)]. A character [14], such as a letter of the alphabet or a number ranging from zero to nine, is disposed through the mid-portion of each character card [13 (G)], [13 (O)], [13 (Y)] or [13 (B)] as shown. Each character [14] is formed by cut-out portions [16] which are narrower in width than the diameter or width of the indicia [12] as shown in FIG. 6. The character [14] of each character card is also constructed and arranged to permit a predetermined number of indicia [12]

to be exposed therethrough upon the superimposition of each character card over a predetermined indicia card [10] as shown in FIGS. 5 and 6. For example, in this embodiment, the indicia [12] are arranged on each individual indicia card [10] in a pattern which will permit four indicia or portions of four indicia [12] of a particular indicia card [10] to be exposed through the cut-out portions [16] which defines the character [14] of only one predetermined matching color coordinated character card [13 (G)], [13 (O)], [13 (Y)] or [13 (B)]. In other words, for each character card [13 (G)], [13 (O)], [13 (Y)] or [13 (B)] only one indicia card [10] having a matching color coordinated strip [11 (G)], [11 (O)], [11 (Y)] or [11 (B)] will permit four indicia [12] or portions thereof to be exposed therethrough as shown in FIGS. 5 and 6. While I have shown each indicia card [10] as having a color coordinated strip [11 (G)], [11 (O)], [11 (Y)] or [11 (B)], it will be apparent from the following description, that this strip may be eliminated whereby each indicia card would have no top or bottom edge. That is, the indicia pattern may be arranged on each indicia card [10] so as to permit the exposure of four (4) indicia [12] through its corresponding character [14] regardless of whether the top edge or the bottom edge of the indicia card is adjacent the top edge of its corresponding character card.

Figure 7:
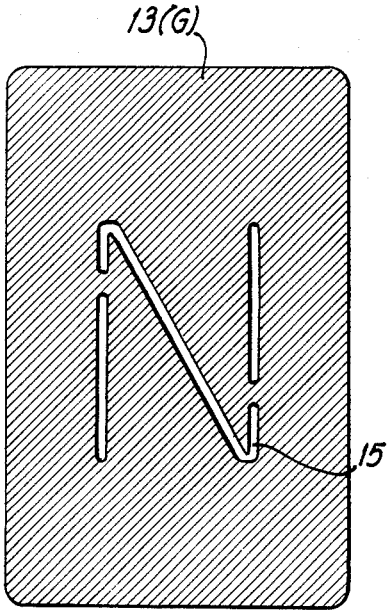
FIG. 7 is an enlarged view showing a typical character card.
Figure 8:
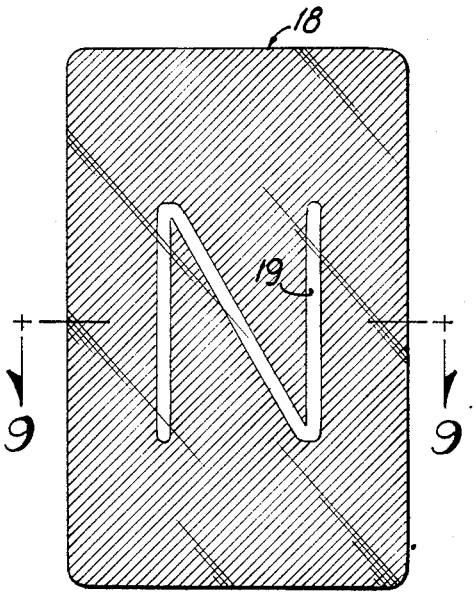
FIG. 8 is a view showing an alternate embodiment of a character card.
Figure 9:
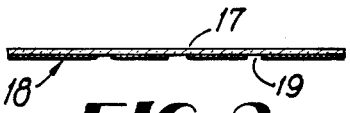
FIG. 9 is a cross-sectional view taken generally along the line 9—9 of FIG. 8.

Referring now to FIGS. 7, 8 and 9, I show an alternate embodiment in the character cards employed with my invention. In FIG. 7, I show a typical dye cut character card having the alphabetic character "N" therethrough which, as you can see, has sharp, acute-angle corners indicated at [15]. When the character cards [13 (G)], [13 (O)], [13 (Y)] or [13 (B)] are shuffled, the sharp cut corners could possible catch on the edges of corresponding shuffled cards and destroy the character card. To alleviate this problem, I show in FIG. 8 an alternate embodiment wherein the character card is made of a celluloid or some other clear material into which the inverse of the character is simply silk-screened forming a clear window through which the indicia or dots [12] may be seen. This method of fabricating a character card would be less expensive and would lengthen the playing life of the cards since there would be no corners to tear and no weakened cross section areas through which the cards would tend to fatigue and crack under constant flexure. In FIG. 9, I show a cross-sectional view taken along the lines 9—9 in FIG. 8 wherein I show a clear celluloid card [17] with a layer of silk-screened printing [18] having openings [19] therein that define a character.

To effect play of my improved card game device where the characters [14] are letters of the alphabet, the players must decide on the number of letters in the word the player must spell in order to win the game. When a forty-eight card deck of indicia cards [10] and a forty-eight card deck of character cards [13 (G)], [13 (O)], [13 (Y)] and [13 (B)] are employed, normally a five letter word for any number of players up to eight is a challenge and fun. That is, the number of letters in the word the player is trying to spell to win the game determines the number of indicia cards [10] that will be dealt to each player.

Figure 2:
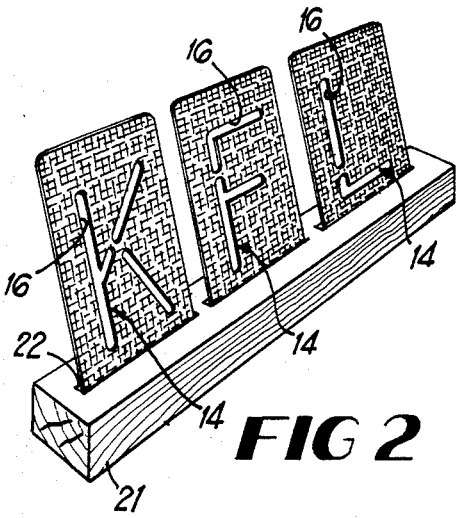
FIG. 2 is a perspective view showing three (3) character cards in a card holder.
Figure 3:
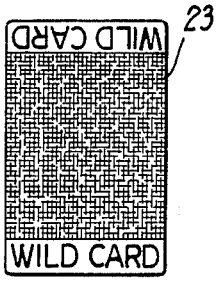
FIG. 3 is a view showing a wild card which may be used to designate any character card.

In FIG. 1, I show a typical hand of cards being played wherein each player has been dealt three indicia cards [10]. While I have shown each of the players as receiving three indicia cards [10] with the indicia cards of each of the players having the same color-coded strip, the players will more than likely have indicia cards with different color-coded strips. The character cards [13 (G)], [13 (O)], [13 (Y)] and [13 (B)] have been shuffled and separated into four sets with the same color in each set. To begin play, a player will draw a card from one of the four sets of character cards having a color which is similar to the color of one of his indicia cards he has been previously dealt. The player will then compare the character card he has drawn with his indicia card to see whether or not a match is achieved whereby four dots or indicia [12] are exposed through the cut-out portions (16) which define the character [14] through the card he chose. To facilitate a player in handling his cards one he has received a match, a card holder [21] having a plurality of upwardly opening slots [22] is provided as shown in FIG. 2. If a player draws a card from one of the four character card sets and cannot use this card, the player will place the character card below the original set he drew the card from to replenish the set. Players can only check indicia cards with the same color character card each time his turn comes to play. When a match is found, the player will keep the character card and pass the turn to the next player. After a player has found a match for all his indicia cards, then that player can attempt to form a correctly spelled word when his turn to play comes again. This allows a player time to formulate an acceptable word while play continues. When that player's turn comes again, a player can attempt to spell a word or pass or even discard one of his indicia cards with the matching character card and then draw a new indicia card. Play then continues to the next player with any player having the option to pass or skip his turn.

One way to effect play of my improved card game device wherein the characters [14] are numbers ranging from zero to nine is for the players to decide on a number having a predetermined number of digits they must achieve in order to win the game. Normally when a fifty-four (54) card deck of indicia cards [10] and a fifty-four (54) card deck of character cards are employed to play the game, a six digit number is challenging fun for any number of players up to eight. That is, the players should choose a number having six digits or less to win the game with the players using the same digit only once. They should write this number down and place it so that each can see this number during the entire game. The character cards are shuffled and separated into four sets with the same color in each set. After the players are dealt a predetermined number of indicia cards, play is begun by a player drawing a character card and comparing it with the indicia cards having the same color coordinated strip across one end thereof as shown in FIG. 5. If the newly-drawn character card permits a predetermined number, preferably four, indicia [12] to be exposed through the numbered character through the card, then the player will keep that card and the turn passes to the next player. When a character card is drawn from a character card set and the player does not have an indicia card to match the character card, the player places the character card below the original character card set.

Players can only check indicia cards with the same color character card each time his turn comes to play. When a match is found, the player will keep the character card and matching indicia card. It is then the next player's turn to play. Any player can discard any of his indicia cards with matching character cards for new indicia cards. To hold or discard any of the indicia cards after a matching character card has been found permits a player to learn strategy whereby he or she may block another player from winning by holding a matching set that another player could employ to win the game. If a player has found a match for all his indicia cards and the number matches the number chosen at the beginning of the game, then that player is the winner of the game when his turn comes again. As stated above, any player has the option to pass or skip his turn or even to discard one of his indicia cards with its matching character card and then draw a new indicia card. When a player discards an indicia card matched with its corresponding character card, the other players may choose this discarded match by discarding a matched indicia card and character card from their own hand. To enhance the game and add excitment, wild cards [23] may also be employed whereby a player may designate the wild card to represent any character in the character card deck to allow that character to be played once a player has drawn or been dealt a wild card.

From the foregoing description, it will be seen that I have devised an improved card game device which is educational and very interesting for players of all ages. My improved card game device is relatively simple in construction and very inexpensive to produce and one which is interesting and amusing to play. My improved card game device also provides a card game which is very easy to comprehend and capable of maintaining a player's interest over a considerable period of time by providing a unique arrangement of indicia [12] on each indicia card [10] wherein it is unknown as to which indicia are dummy dots and which are active exposed dots. Players of good memory find it very difficult to recognize what indicia patterns match with a particular character prior to actually checking the two cards. This feature equalizes the chances of all players to win the game by removing the mental advantages one player may have over the other.

While I have shown my invention in several embodiments, it is to be understood that it is not so limited but is susceptible to various changes and modifications without departing from the spirit thereof.

What I claim is:

1. A card game device comprising;

(a) a first set of cards with each card of said first set provided with a plurality of spaced-apart dots which are of a predetermined size and shape and arranged in a predetermined pattern on at least one face of each card of said first set of cards and, (b) a second set of cards with each card of said second set of cards provided with a letter of the alphabet disposed through its mid-portion thereof with said letter of the alphabet constructed and arranged to permit a predetermined number of said dots to be exposed therethrough upon the superimposition of each card of said second set of cards over a predetermined card from said first set of cards.

2. A card game device comprising:

(a) A first set of cards with each card of said first set provided with a plurality of spaced-apart dots which are of a predetermined size and shape and arranged in a predetermined pattern on at least one face of each card of said first set of cards and, (b) a second set of cards with each card of said second set of cards provided with a number ranging from zero to nine disposed through its mid portion thereof with said number constructed and arranged to permit a predetermined number of said dots to be exposed therethrough upon the superimposition of each card of said second set of cards over a predetermined card from said first set of cards.

3. A card game device as defined in claim 1, wherein each card of said first set of cards is provided with at least eight said dots.

4. A card game device as defined in claim 1, wherein four said dots are exposed through said letter of the alphabet upon the superimposition of each card of said second set of cards over a predetermined card from said first set of cards.

5. A card game device as defined in claim 4 wherein each said card of said first set of cards includes spaced apart longitudinal sides and spaced apart ends and with the dot pattern on each said card of said first set of cards arranged to permit four said dots to be exposed through said letter of the alphabet selectively in a first position with one end of each said card of said first set of cards adjacent one end of its corresponding card from said second set of cards and in a second position with the other end of said card from said first set of cards adjacent said one end of said card from said second set of cards.

6. A card game device as defined in claim 1, wherein cut-out portions of a width narrower than the diameter of said dots define each said letter of the alphabet through each card of said second set of cards.

7. A card game device as defined in claim 2, wherein each card of said first set of cards is provided with at least eight said dots.

8. A card game device as defined in claim 2, wherein four said dots are exposed through said number upon the superimposition of each card of said second set of cards over a predetermined card from said first set of cards.

9. A card game device as defined in claim 8 where each said card of said first set of cards includes spaced apart longitudinal sides and spaced apart ends and with the dot pattern on each said card of said first set of cards arranged to permit four said dots to be exposed through said number selectively in a first position with one end of each said card of said first set of cards adjacent one end of its corresponding card from said second set of cards and in a second position with the other end of said card from said first set of cards adjacent said one end of said corresponding card from said second set of cards.

10. A card game device as defined in claim 2, wherein cut-out portions of a width narrower than the diameter of said dots define each of said number through each card of said second set of cards.

* * * * *